United States Patent [19]

Vallance

[11] Patent Number: 4,972,176

[45] Date of Patent: Nov. 20, 1990

[54] POLYMERIC SECURITY WINDOW WITH AN INTEGRATED INTRUSION DETECTOR

[75] Inventor: Michael A. Vallance, Chappaqua, N.Y.

[73] Assignee: General Electric Company, Schenectady, N.Y.

[21] Appl. No.: 407,981

[22] Filed: Sep. 15, 1989

[51] Int. Cl.[5] ..... G08B 13/04

[52] U.S. Cl. ..... 340/550; 52/171; 109/21; 174/126.4; 340/531; 350/96.15

[58] Field of Search ..... 340/550, 531; 109/21, 109/10, 49.5; 52/171; 174/126.4, 122 G; 350/96.15

[56] References Cited

U.S. PATENT DOCUMENTS

| | | | |
|---|---|---|---|
| 3,441,925 | 4/1969 | White | 340/550 |
| 3,825,917 | 7/1974 | Lucky | 340/550 |
| 4,367,460 | 1/1983 | Hodara | 340/530 |
| 4,692,744 | 9/1987 | Hickman | 340/590 |
| 4,867,524 | 9/1989 | Courtney et al. | 350/96.15 |
| 4,878,044 | 10/1989 | Hickman | 200/61.08 |

*Primary Examiner*—Glen R. Swann, III

*Attorney, Agent, or Firm*—William H. Pittman; James C. Davis, Jr.

[57] ABSTRACT

The security window is a laminated pair of polymeric panels having electrically conductive rods sandwiched therebetween. Glass fibers, having electrically conductive coatings, extend from edge to edge of the plastic window panels and are distributed in the rods which substantially cover the entire window area. The index of refraction of the coated glass fibers is as identical as possible to that of the surrounding plastics, making the electrically conductive rods substantially invisible. The conductive rods are connected in series. The resistance characteristics of the circuit are monitored to detect damage to the window.

15 Claims, 2 Drawing Sheets

POLYMERIC SECURITY WINDOW WITH AN INTEGRATED INTRUSION DETECTOR

FIELD OF THE INVENTION

This invention relates generally to a security window of the type including means for detection of damage thereto and, more particularly, concerns a polymeric window having invisible damage protection means molded therein.

BACKGROUND OF THE INVENTION

Prior art burglar alarm systems in elemental forms involving glass panels have a disadvantage in that sensing elements on or embedded in the glass are visible, which defeats a fundamental purpose for using glass. For example, thin electrically conductive tapes or strips have been applied to the glass periphery in a substantially complete loop. When the glass is broken, the tape is severed and an electrical circuit is broken. This initiates a chain of electrical events resulting in the production of a signal indicating that the glass has been broken. However, such tapes are usually visible. Therefore, they are positioned only around the periphery of the glass area so as not to obstruct the view. Large areas of glass are unprotected and a skilled burglar, intent on entry, may cut the glass while avoiding the visible electrically conductive tape. Alternatively, a hole may be cut through the glass in an area where the tape is absent, through which the burglar reaches in and short circuits the tape between its entry and exit points on the glass panel. As a result, no alarm is ever produced when the glass is broken even though portions of the tape may be severed. The metallic tape may also be unattractive, as well as obstructive, in the environment of the glass panel.

Recently, systems have been devised which respond to sounds or other vibrations produced by intruders. Unfortunately, normal ambient sounds and vibrations may be at a higher level than those caused by a burglar breaking a glass panel. Thus, many false alarms may result in such systems.

What is needed is a security window which provides protection over the entire window area and which is invisible or substantially invisible to the human eye.

Accordingly, it is an object of this invention to provide an improved security window which contains integral intruder detection sensors which are not visible.

Another object of the invention is to provide an improved security window which contains intrusion detection sensors over any desired window area without significantly affecting window transparency.

A further object of this invention is to provide an improved security window which is damage resistant and not subject to false alarms in operation.

Yet another object of this invention is to provide an improved security window which uses conventional plastic window materials and is economic to produce.

Generally speaking, in accordance with the present invention, a polymeric security window is provided which is especially suitable for applications requiring excellent transparency. The security window is a lamination of a pair of polymeric window panels having sandwiched therebetween electrically conductive rods for transmission of electric current therethrough. The primary current transmission medium is composed of coated glass fibers extending from one edge of the plastic window panels to the opposite edge and distributed in strips or rods which substantially cover the entire window area. The glass fibers, coated with an electrically conductive material, are sealed in a plastic material which is preferably the same as the polymeric window panels. The index of refraction of the coated glass fibers is selected to be as close as possible to that of the surrounding plastics, so that minimum distortion of images results when viewing objects through the window. For all practical purposes, the electrically conductive rods are therefore invisible.

The electrically conductive rods which form a grid over the transparent window panel are electrically connected in series circuit, and a current source provides a constant current through the circuit. The resistance of the circuit increases when a rod is severed, partially severed, or punctured and at least some of the electrically conductive glass fibers are severed. A change in the magnitude of voltage required to maintain a constant current in the circuit indicates that a window panel and at least some of the glass fibers have been damaged. Alternatively, a constant voltage may be applied to the circuit. In this case, changes in current flow indicate damage to the window panel. Also, where many window panels in different circuits are under surveillance, the status of the windows may be checked sequentially on a time-shared basis. Comparison of present readings against prior readings for the same window panel may also be the basis for indicating when a panel has been damaged and an alarm signal is to be generated.

The electrically conductive rods may be incorporated into polymeric windows now in general use.

Other objects, features and advantages of the invention will be apparent from the specification. This invention accordingly comprises the features of construction, combination of elements and arrangement of parts which will ba exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
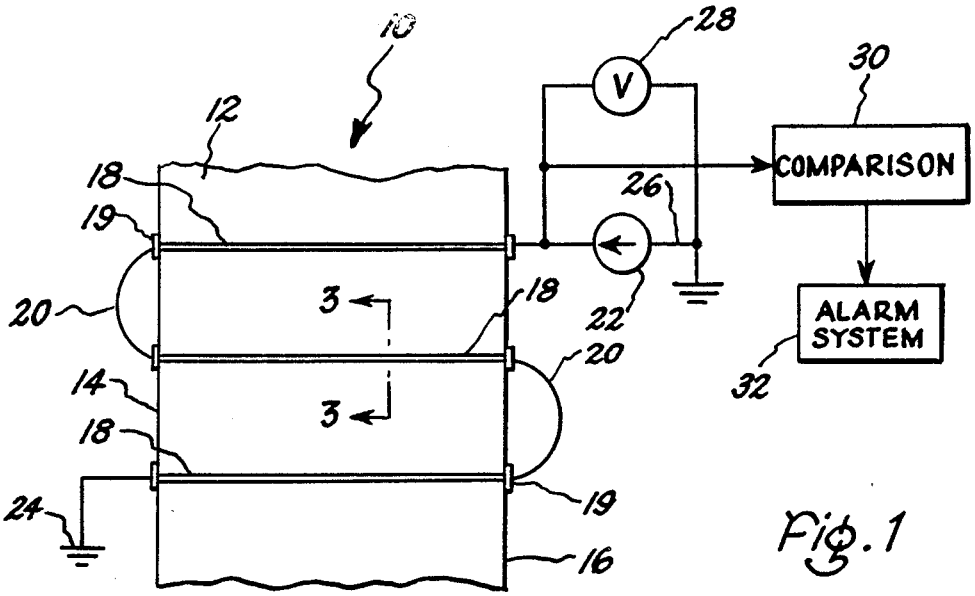
FIG. 1 is a fragmentary front view of a security window in accordance with the invention.

A security window 10, embodying the invention, includes a window panel. 12 bounded by edges 14, 16. Electrically conductive rods 18, as described more fully hereinafter, are contained within the window panel 12 and extend between the window edges 14, 16. The electrically conductive rods 18 are connected electrically in series by means of end terminals 19 and intermediate wires 20 and the interconnected rods 18 are connected with a constant current source 22 of conventional construction. Current flows from the source 22 through the rods 18, terminals 19 and intermediate wires 20 to ground 24 and returns to the grounded end 26 of the current source 22.

A voltmeter 28 measures the voltage produced across the constant current source 22 when a predetermined level of current flow is provided to the conductive rods 18. The voltage across the current source 22 is provided as an input to comparison circuits 30 where the inputted signal is compared against a standard representing performance of the conductive rod circuit under normal operating conditions, when no physical impairment has been inflicted upon the window panel 12. In such situations, the comparison circuits 30 associated with the current source 22 do not provide a signal output which activates an associated alarm system 32. However, if any of the conductive rods 18 is damaged, for example, by being partially severed, punctured, or entirely severed, the voltage signal, input to the comparison circuits 30, will compare unfavorably against the acceptable standards of rod performance. In other words, the circuit resistance is increased by damage to the window panel 12 and its conductive rods 18, and the voltage required at the current source 22 to maintain a constant current increases. In such instances, a signal from the comparison circuits 30 activates the alarm system 32.

Those skilled in the art will appreciate that the circuits could be made responsive to a range of resistance, so that any increase or decrease which places resistance out of the range would result in an alarm. An example of such a circuit is the Wheatstone bridge. Circuits serving this purpose would foil attempts to short circuit one or more rods in a panel, in an effort to penetrate an area thereof without detection.

Each electrically conductive rod 18, embedded in the window panel 12, is substantially invisible. The number of such rods and the spacing of the rods is determined by the intended application of the security window 10. For example, if the security window 10 is protecting a jeweler's showcase, the rods 18 may be spaced sufficiently close so that no object of displayed jewelry can pass through the space between adjacent conductive rods. Thus, anyone making e hole in the window panel 12 which hole is sufficiently large to pass jewelry therethrough will need to make an opening which results in damage to at least one conductive rod 18.

To improve sensitivity of the system, a plurality of independent circuits of conductive rods can be included in a single window panel 12, with each circuit covering a different physical area of the panel. The conductive rod circuits may be driven separately and in a predetermined sequence. Thus, damage to even one conductive rod is more readily detected than in a single circuit having a large number of rods connected in series. The total number of rods in a panel in each construction may be the same. It will also be appreciated that the rods need not be connected in series circuit, but could be in parallel or a combination of series and parallel.

The intermediate wires 20 and the rod ends are concealed and protected in window framing (not shown) which borders the panel edges 14, 16.

The electronic circuitry 22, 30 and the alarm system 32 are conventional components and accordingly are not described in detail herein.

Figure 3:
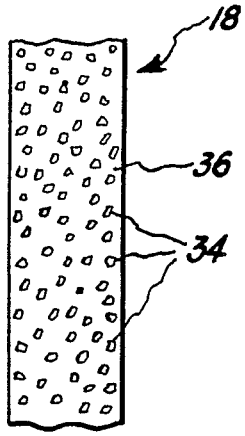
FIG. 3 is a sectional view, on an enlarged scale, along the line 3—3 of FIG. 1, looking in the direction of the arrows.

The conductive rods 18, as shown in FIG. 3, preferably include a highly collimated tow of glass fibers 34 which are coated with a thin film of a conductive material such as carbon, copper, iron or nickel in order to make the rod 18 minimally conductive. Coatings in the order of 0.10 microns and less in thickness are suited to this application. Minimal conductivity reduces the current requirements in the circuit and associated power dissipation. A thin coating provides transparency to light. The glass fibers 34, typically E-glass fibers, after coating with the conductive material, are embedded in a polymeric material 36 to form the conductive rod 18. Coated glass fibers 34 typically represent 40% to 70% of the conductive rod volume. The polymeric material 36 has the following desirable characteristics, namely, good optical properties and an index of refraction matched closely with the index of refraction of the coated fibers 34. Also desirable is a material 36 providing good adhesion to the coated fibers 34 and good formability. Polycarbonates and acrylic-modified polycarbonates serve well for this purpose.

The glass fibers may be coated with the conductive material by well-known techniques, for example, chemical vapor deposition. After coating, the fibers may be subsequently treated, that is, sized with a finish which protects the coating and the fiber. Suitable sizing materials include alkyl titanates and epoxides, especially expoxy functional silanes. The finish also provides a mechanism for wetting and adhesion between the fibers 34 and the resin matrix 36. The thickness and composition of the metal coating on the glass fibers is chosen to maximize light transmissivity and minimize the amount of current required while still making said coating the path of least resistance and avoiding the passage of stray currents into the polymeric material 36.

The conductive rods 18 are initially formed in a length greater than the width of the window panel 12 between the window edges 14, 16. Electrical connection is made to the ends of the rods 18 by any of a number of methods. In one method, the exposed ends of the rod 18 are treated with intense heat, causing thermal degradation and vaporization of the resin 36 in that region, leaving the coated fibers 34. This treated rod end is then potted in a conductive paste or other conductive potting compound, making the entire end of the conductive rod 18 into an electrode 19.

To assure that the good optical properties of the selected polymeric material are not lost when combined with the fiber tow, the fibers should be thoroughly surrounded by the polymeric material. That is, the fiber tow should be completely impregnated with the polymeric material. Such impregnation may be accomplished simultaneously with formation of the plastic conductive rod 18. For example, the tow of coated fibers may be sandwiched between two half-thickness sheets of the selected polymeric material. Then the fibers and the polymeric material are laminated to form a thick sheet with embedded fibers 34. Alternatively, the tow of collimated fibers 34 may be pre-impregnated with resin either by solution or hot melt methods known in the art.

Pultrusion offers one such method and pultrusion of these rods with, for example, cyclic polycarbonate oligomers of the type disclosed in U.S. Pat. No. 4,740,583, is an acceptable method for producing conductive rods 18. In this method, the fiber tow is pulled through a low viscosity resin bath such that the resin sticks to the fibers. The tow is then pulled through a die, preferably with a rectangular cross section, thereby producing a ribbon-like rod of extended length having the glass fibers running lengthwise therein. Where cyclic prepolymers, such as polycarbonate oligomers, are used to contain the fiber glass tow, these materials can be polymerized during formation of the conductive rod or subsequently during lamination into the window panels 12.

The conductive rods 18 are generally formed as flat bars (FIG. 2) in cross section. A typical conductive rod will have a height 40 of ½ inch and a thickness 42 in the order of 2–20 mils (0.002 to 0.020 inch).

Figure 2:
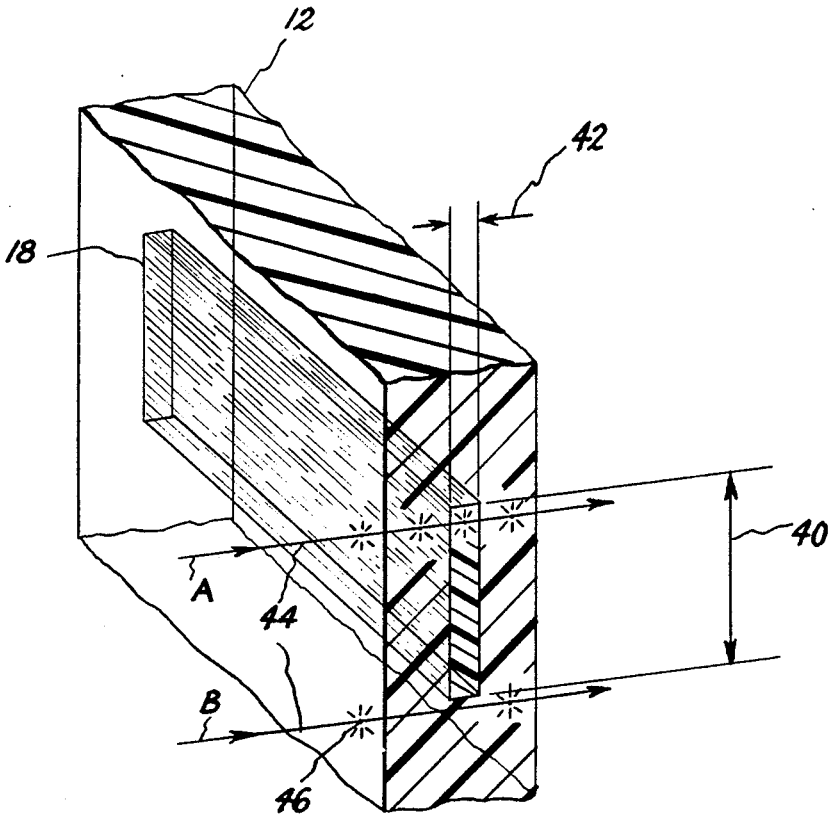
FIG. 2 is a perspective view, on an enlarged scale, of the window of FIG. 1, with parts omitted to simplify description.

Such flat rods 18 have advantages. Namely, they are easily produced using slit or roller dies. They are produced with minimal void content because direct pressure is easily applied over most of the perimeter and the path length for escaping volatiles is relatively short. The thin flat conductive rods 18 fit easily between sheets of polymeric materials which are to be laminated together. Also, as illustrated in FIG. 2, the conductive rod 18 offers minimal path length to impinging light rays 44. Because exact index of refraction matching between the fibers 34 and the resin 36 (FIG. 3) is impossible, minimizing the thickness 42 has the advantage of minimizing opacity due to light scattering, and minimizes striped patterns which occur in window panes due to different transmissivity, for example, at locations where the light ray 44 passes through the conductive rod 18 in comparison with the locations where the light ray 44 passes through the window panel 12 without passing through a conductive rod 18. Starburst patterns 46 are included in FIG. 2 to indicate interfaces between the ambient air and the window panel 12 and between the window panel 12 and the conductive rod 18, through which rays 44 of light pass in travelling through the window 10.

Additionally, for a given number of glass fibers 34 within the conductive rod 18, a maximum cross section to any physical penetration is presented when the conductive rods 18 are flat strips, as illustrated in FIG. 2, and penetration of the window 10 is more likely to intercept a conductive rod 18 when the conductive rod height 40 is large, based on probabilistic considerations.

While the advantages of a rod type conductor 18 as illustrated in FIGS. 1 and 2 have been discussed above, it should be understood that in alternative embodiments of a security window system in accordance with the invention, the conductive rods need not be limited to such a rectangular cross section. The conductive rods 18 need not be straight and need not be perpendicular to the parallel side edges 14, 16 as illustrated in FIG. 1. The cross section of the conductive rod 18 may be of any shape so long as good impregnation of the glass fibers therein is accomplished. The conductive rod may be, for example, a loop encircling the window panel periphery or a spiral extending outwardly from the window's center. The cross section of FIG. 3 is intended to illustrate coated glass fibers 34 embedded in the polymeric material 35 and is not intended to indicate that the fiber cross section need be round. Other cross-sectional shapes, as are available or become available, may be suited to this application.

Optimally, the resin 36 used to form the conductive rod 18 is the same resin as used in the panel 12. The conductive rod 18 is laminated, by known processes using heat and pressure, between two sheets of plastic which form the panel 12. Residual stresses may exist due to a mismatch in coefficient of thermal expansion between the coated glass fibers 34 ($\alpha f$) and the resin 36 ($\alpha r$) even when the resins in the panels 12 and conductive rods 18 are the same. Mismatch in coefficient of thermal expansion is a source of light scattering and polarization of the impinging light. In such instances, the view through the window will not be uniform and a striped pattern may be apparent in any window panel, whether made of plastic or conventional glass. The problem of mismatched thermal expansion coefficients is minimized by prestraining the fibers of the conductive rods 18 during the lamination cycle and releasing the prestress (tension) on the fibers after cool-down. The proper amount of prestrain to apply to the conductive rods 18 before lamination into the window panel 12 is readily calculated from a knowledge of the expansion coefficients, the resin glass transition temperature Tg, and ambient temperature Ta. The fiber glass tows are stretched before impregnation to a strain of $(\alpha r-\alpha f)(Tg-Ta)$ which corresponds to a stress of $Ef(\alpha r-\alpha f)(Tg-Ta)$, wherein Ef is the Young's modulus of elasticity of the fiber. After impregnation and cool-down, the tension (stress) on the fibers 34 is released. The result is that the fibers 34 and the surrounding plastic 36 are in stress free states. Thus, distortions which might be introduced by the conductive rods 18 per se are reduced.

In operation, the current source 22 provides a selected constant current to the circuit of conductive rods 18 and intermediate wires 20. A simple threshold detector may be used in the comparison circuits 30 to detect penetration of the window panel 12 which physically modifies a conductive rod 18. In normal operation, the received signal, that is, the voltage level as indicated by the voltmeter 28, always falls below a predetermined threshold level and no alarm is sounded. If a conductive rod 18 is altered physically, the signal received at the comparison circuits 30 increases in level as the current source 22 maintains the selected current value. When the signal rises above the threshold level, the circuits 30 provide a signal to the alarm system 32.

The signal from the output of the current source 22 to the comparison circuits 30 may be provided continuously or on an intermittent sampling basis. Using sampling techniques, it is possible for one set of electronics 30, 32 to monitor many circuits, whether in the same panel 12 or in a large number of panels 12. In one alternative embodiment in accordance with the invention, the current source 22 is applied to the conductive rod circuitry on an intermittent basis rather than continuously such that one current source 22 may also be used to service many circuits and window panels in a predetermined sequence. In another alternative embodiment in accordance with the invention, a sampled signal from the output of the current source 22 may be compared with the previous signal received from the same conductive rod circuit. Changes between two consecutive signals exceeding a certain magnitude may be used to trigger the alarm system 32. As stated, the electronic circuitry is not considered to be a novel portion of the invention and those skilled in the art will readily find many options for receiving and utilizing the signals produced at the output of the current source 22. Where comparisons are made between sequential signal samples, the need for a constant current source is reduced and any reasonably regulated power supply will suffice provided that samples are not separated by long time intervals.

Additionally, changes in the circuit resistance within the window panel 12 may be monitored by measuring changes in current where voltage is held substantially constant. Comparison of current level against predetermined standards may be used as the criteria for sounding an alarm or sample-to-sample comparisons can be made to detect sudden changes of significant magnitude and permanence.

In addition to detecting the changes in current or voltage when a rod 18 is damaged, the circuits can be constructed to also detect a short circuiting of conductive rods 18 or short circuit of the output of the supply circuit. In such instances, an opposite effect is produced, that is, measured voltage would drop in the constant current system, and measured current would increase in the constant voltage system. Therefore, the systems would be constructed to operate normally between upper and lower threshold limits. Crossing either limit would be a basis to activate the alarm system 32.

Further, the invention need not be limited to the rods 18 filled with conductively coated glass fibers., Any visually transparent member which is electrically conductive or has a visually transparent media associated therewith which makes it electrically conductive may serve satisfactorily in a security window in accordance with the invention.

Also, an electrically conductive, visually transparent film may be deposited, printed, rolled, etc., on a surface of the panel 12 to form a grid or pattern giving the same physical coverage as a plurality of rods 18. The rods 18 and intermediate terminals 19 and wires 20 would be eliminated by providing a continuous transparent conductor on the panel 12. End terminals of conductive foil, which extend beyond the panel edges 14, 16, could be laminated into the panel for connection of the panel to the electrical circuits which activate the security system.

It will thus be seen that the objects set forth above and those made apparent from the preceding description are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A security window system comprising:

a window panel, said window panel being substantially electrically non-conductive;

an electrically conductive rod having first and second ends and extended length therebetween, said rod being joined to said window panel, said rod including a plurality of glass fibers oriented in the lengthwise direction of said conductive rod between said ends, the outer surface of said glass fibers having an electrically conductive coating thereon.

2. A security window system as claimed in claim 1, wherein said panel and said conductive rod are substantially transparent.

3. A security window system as claimed in claim 1, and further comprising:

means for applying an electrical signal to said rod thereby producing an electrical current flow through said rod between said ends;

means for detecting at least one of voltage and current applied to said rod by said means for applying, in order to determine the conduction characteristic of said rod;

means for comparing said determined conduction characteristic of said rod against a preselected standard of rod conduction, and for producing a signal indicative of deviation of said detected characteristic from said standard.

4. A security window system as claimed in claim 1, wherein said conductive rod comprises said plurality of coated fibers contained in a matrix formed of a plastic, said plurality of coated glass fibers and said plastic matrix having substantially the same index of refraction to light, and wherein said window panel is formed of plastic, said plastic of said rod and said plastic of said window panel having substantially the same index of refraction to light.

5. A security window system as claimed in claim 4, and further comprising a second window panel similar to said first-recited window panel, said second panel being joined to said conductive rod and to said first-recited panel, said conductive rod being positioned between said panels.

6. A security window system as claimed in claim 1, wherein said joining of said rod to said window panel is the product of application of at least one of heat and pressure.

7. A security window system as claimed in claim 1, and further comprising a second window panel similar to said first-recited window panel, said second panel being joined to said conductive rod and to said first-recited panel, said conductive rod being positioned between said panels.

8. A security window system as claimed in claim 7, wherein said joinings of said conductive rod and panels are the products of application of at least one of heat and pressure.

9. A security window system as claimed in claim 7, wherein said panels and said conductive rod are substantially transparent.

10. A security window system as claimed in claim 1, and further comprising at least one additional conductive rod joined to said window panel, said rods being spaced apart and electrically connected.

11. A security window system as claimed in claim 1, wherein said conductive coating is transparent to light.

12. A security window system as claimed in claim 11, wherein said conductive coating is not greater than 0.1 microns in thickness.

13. A security window system as claimed in claim 11, wherein said coating is one of carbon, copper, iron or nickel.

14. A security window system as claimed in claim 12, wherein said coating is one of carbon, copper, iron and nickel.

15. A method for detecting penetration of a transparent window panel, comprising the steps:

(a) applying a conductive rod containing coated glass fibers to said window panel in a region of potential penetration, said fibers being coated with an electrically conductive material, said rod being substantially indistinguishable visually from said panel and being substantially more conductive of electrical current than said panel, said rod having a first end and a second end;

(b) applying an electrical signal to produce a current flow in said conductive rod between said ends;

(c) measuring the value of at least one of the voltage across and current in said conductive rod;

(d) comparing the measured value against a corresponding preselected standard of conductive rod performance; and (e) producing a signal indicative of deviation of said measured value from said standard.

* * * * *